US008494209B2

(12) United States Patent
Miller et al.

(10) Patent No.: US 8,494,209 B2
(45) Date of Patent: Jul. 23, 2013

(54) LOW AXIAL VIBRATION RECEIVER ARMATURE AND ASSEMBLY

(75) Inventors: Thomas E. Miller, Arlington, IL (US); Clifford Ryan Grounds, Bloomingdale, IL (US); Henry Nepomuceno, Glendale Heights, IL (US); David E. Schafer, Glen Ellyn, IL (US); George Patterson, Lombard, IL (US)

(73) Assignee: Knowles Electronics, LLC, Itasca, IL (US)

( * ) Notice: Subject to any disclaimer, the term of this patent is extended or adjusted under 35 U.S.C. 154(b) by 437 days.

(21) Appl. No.: 12/777,352

(22) Filed: May 11, 2010

(65) Prior Publication Data

US 2010/0284561 A1 Nov. 11, 2010

Related U.S. Application Data

(60) Provisional application No. 61/177,106, filed on May 11, 2009.

(51) Int. Cl.
*H04R 1/00* (2006.01)

(52) U.S. Cl.
USPC ..... 381/418

(58) Field of Classification Search
USPC ..... 381/418, 412
See application file for complete search history.

(56) References Cited

U.S. PATENT DOCUMENTS

2001/0022844 A1* 9/2001 Urushibata et al. ..... 381/318

FOREIGN PATENT DOCUMENTS

| | | | |
|---|---|---|---|
| JP | 2001-268692 | A | 9/2001 |
| JP | 2006-041768 | A | 2/2006 |
| JP | 2006-186615 | A | 7/2006 |
| JP | 2007-074499 | A | 3/2007 |

OTHER PUBLICATIONS

International Search Report and Written Opinion of PCT/US2010/034355, dated Nov. 30, 2010.

* cited by examiner

*Primary Examiner* — Jianchun Qin
(74) *Attorney, Agent, or Firm* — Fitch, Even, Tabin & Flannery, LLP

(57) ABSTRACT

An armature apparatus includes a first tine member, a second tine member, a center tine member, and a connecting portion. The first tine member has a first length and a first width and these define a first surface. The second tine member has a second length and a second width and these define a second surface. The first surface generally faces the second surface and the first surface is generally parallel relation to the second surface. The center tine member has a third length and the third length is generally parallel to the first length and the second length. The connecting portion couples the center tine member to the first surface along the first length and to the second surface along the second length. The center tine member is generally disposed in a plane extending between the first tine member and the second tine member and the plane divides the first surface of the first tine member and the second surface of the second tine member.

4 Claims, 15 Drawing Sheets

←100

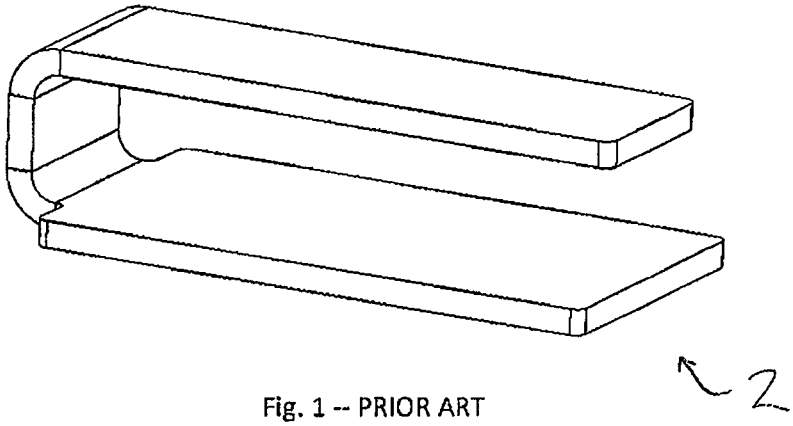
Fig. 1 -- PRIOR ART
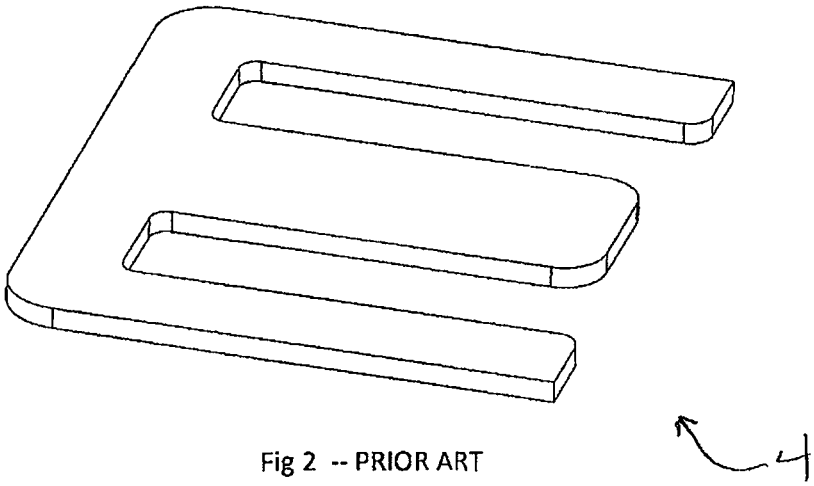
Fig 2 -- PRIOR ART

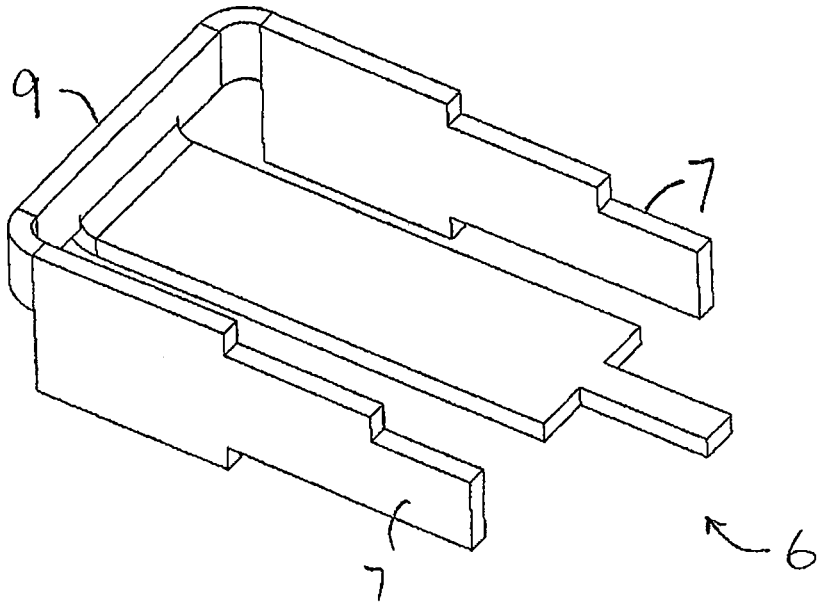
Fig. 3 -- PRIOR ART
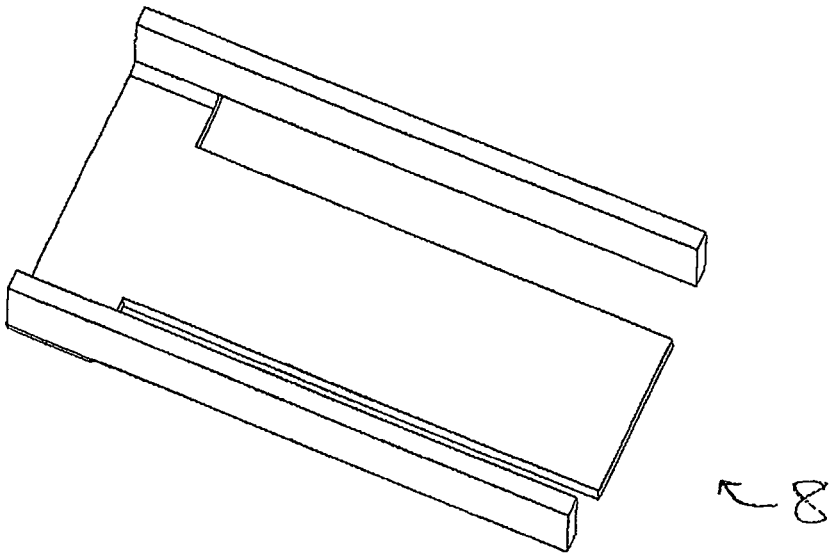
Figure 4 -- PRIOR ART

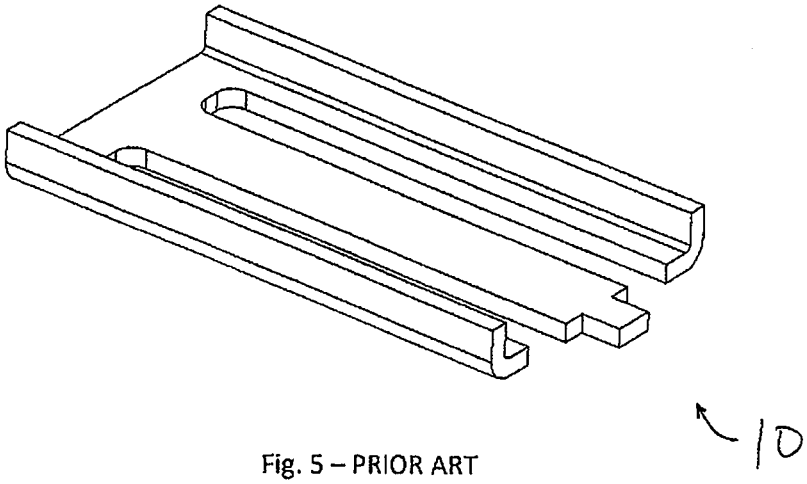
Fig. 5 – PRIOR ART
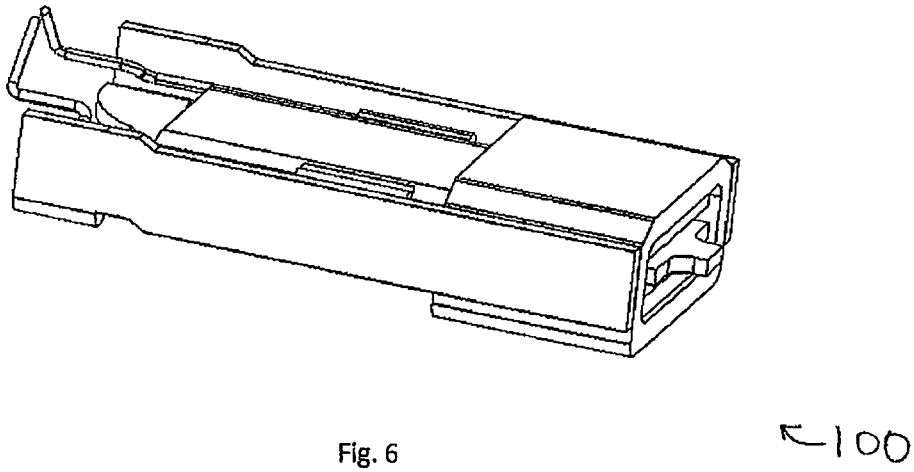
Fig. 6

LOW AXIAL VIBRATION RECEIVER ARMATURE AND ASSEMBLY

CROSS REFERENCE TO RELATED APPLICATION

This patent claims benefit under 35 U.S.C. §119 (e) to U.S. Provisional Application No. 61/177,106 entitled "Low Axial Vibration Receiver Armature" filed May 11, 2009 the content of which is incorporated herein by reference in its entirety.

TECHNICAL FIELD

This patent application relates to armature designs for receiver assemblies which provide performance with low levels of vibration.

BACKGROUND OF THE INVENTION

Hearing instrument acoustic gain is primarily limited by feedback of the output signal back to the input of the device. Mild amounts of feedback change the transfer function of the system, thereby coloring the sound output. Larger amounts of feedback will cause instability and oscillation (squealing noises). There are multiple paths for feedback, one of which is the mechanical vibration of the hearing instrument receiver. The case of the receiver vibrates in reaction to the motion of the internal parts. This vibration, in turn, couples to the diaphragm in the hearing instrument microphone, either directly, or indirectly through the hearing instrument case moving the air that is near the microphone.

The vibration of receivers can be largely cancelled out by connecting a pair of receivers together such that their primary direction of vibration is in opposition. The motion of the two devices then cancels, greatly reducing the net vibration. Unfortunately, the receivers have vibration components in both the vertical and horizontal directions. When two receivers are combined together, the vertical components cancel, but the horizontal portion adds to the vibration.

Thus, there is a need for receivers that have vibration strictly in the vertical direction, with no vibration in the horizontal direction. There is also a need to make the hearing instrument as small as possible, to improve the fit of the device into the ear canal, or to reduce the visibility of the instrument. The need for a smaller sized hearing instrument creates a need for a smaller sized receiver. The receiver size can be reduced by folding the armature, such as that design seen in known receivers. Armatures 2, 4, 6 which are used in balanced armature receivers typically use a U or E shaped armature (see FIGS. 1-3), where one portion of the armature is free to move, and the other portion is fixed to a magnetic yoke to complete the magnetic circuit. To carry the maximum amount of magnetic signal, the cross-sectional area of the fixed portion must be at least as large as the moving portion. If there is less area, then the maximum level of sound that the receiver can produce may be reduced.

A flat E-shaped armature 4, as shown in FIG. 2, has no vibration along its length at the primary frequency of motion. The only lengthwise vibration is a component at double the frequency of the primary motion. This double frequency is benign, as it does not contribute to feedback in the hearing instrument. However, the armature takes up significant width. The outer tines 7 and the connecting portion 9 of the armature 6 are typically folded perpendicular to the moving portion to save space, as shown in FIG. 3. This introduces a tradeoff of width and vibration. In other embodiments, if the connection portion is folded out of the plane of the moving portion of the armature, the motion of the connection portion may introduce an unwanted horizontal component to the receiver vibration. Folding just the sides, as shown in the armature 8 of FIG. 4, prevents axial vibration, but requires too much height for a smaller-sized receiver design. A modified version of this fold shown in an armature 10 (illustrated in FIG. 5) utilized in a known receiver, reduces the height requirement, but requires additional width.

BRIEF DESCRIPTION OF THE DRAWINGS

For a more complete understanding of the disclosure, reference should be made to the following detailed description and accompanying drawings wherein:

FIG. 1 is a perspective view of a prior art armature used for prior art receiver assemblies;

FIG. 2 is a perspective view of another prior art armature used for prior art receiver assemblies;

FIG. 3 is a perspective view of another prior art armature used for prior art receiver assemblies;

FIG. 4 is a perspective view of yet another prior art armature used for prior art receiver assemblies;

FIG. 5 is a perspective view of another prior art armature used for prior art receiver assemblies;

FIG. 6 is a perspective view of a receiver assembly in an embodiment of the present invention;

Figure 7:
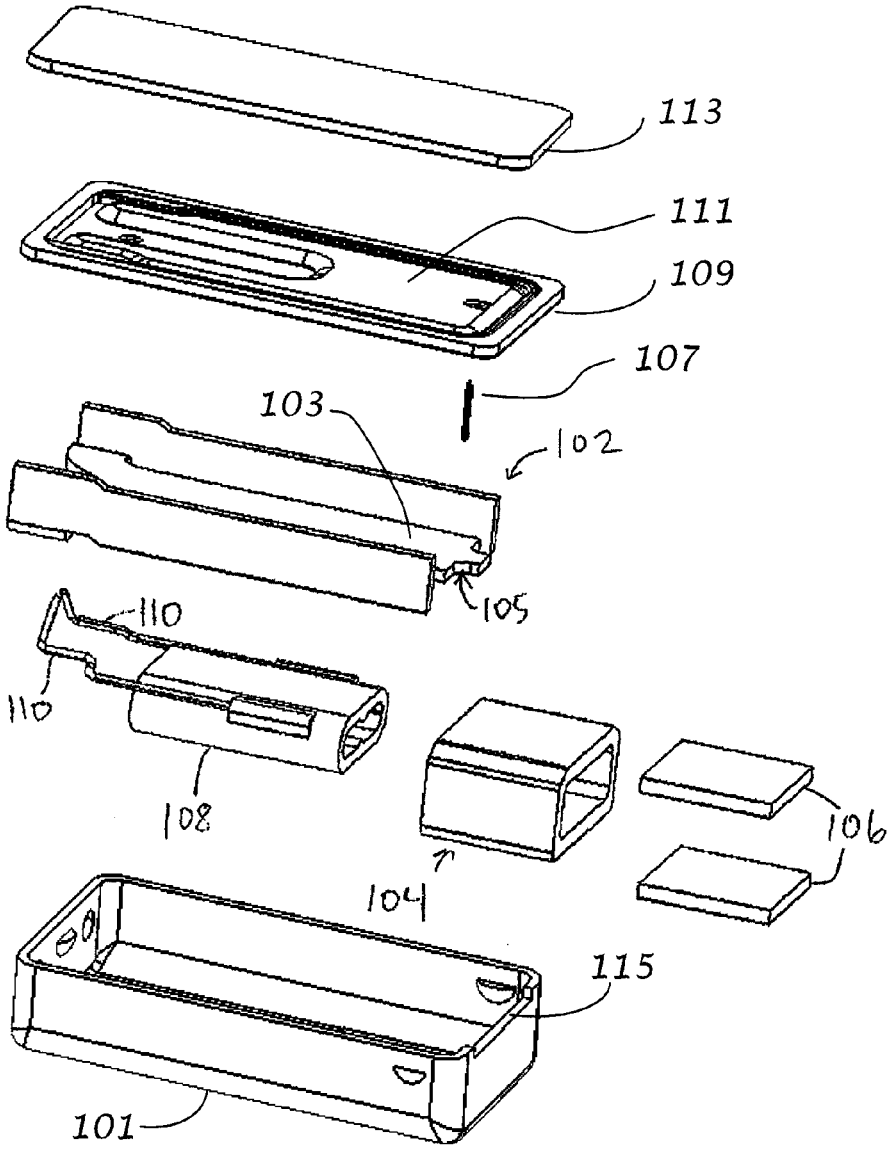
FIG. 7 is an exploded view of the receiver assembly of FIG. 6.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

The present approaches generally relate to armatures for receiver assemblies which reduce vibration in one or both of the horizontal and vertical directions. The vertical portion is primarily due to the vertical motion of the armature, and to a lesser extent, to the motion of the diaphragm assembly. In prior approaches, vertical motion of the armature tip typically causes a small amount of horizontal motion near the pivoting end of the armature. In the approaches described herein, the horizontal motion can be reduced or eliminated if, for example, the pivoting end is constructed in the same plane as the moving portion of the armature.

The present approaches provide devices that are of a sufficiently small and compact size to be used in miniature audio devices. The small size (as compared to prior devices) is obtained at least in part by the positioning of the center tine relative to the outer tines. In some examples, this disposition of the components minimizes the height of the overall magnetic assembly (including, for example, the armature, coil, and yokes) because the height of the outer tines can be reduced. Thus, as compared to previous approaches and in some aspects, the outer tines no longer extend above the yoke thereby reducing the overall height of the assembly as compared to previous approaches.

In some aspects, the substantial reduction or elimination of horizontal movement of the center tine is obtained by the coupling of the center tine to a length-wise section (e.g., a side surface or an underside) of the side tines of the armature. In other examples, the center tine is coupled to a cross-bar like connecting portion or member such that approximately one-half of the area of the connecting portion is above the center tine (at the connection point) and approximately one half of the area of the connecting portion is below the center tine (at the connection point). The stiffness of the two sections of the connecting portion (e.g., as measured in newtons/meter) is substantially equal thereby substantially reducing or eliminating horizontal vibrations of the center tine when the center tine moves in a vertical (i.e., up/down) direction.

In other aspects, a receiver assembly or other audio device is provided that is of a small and compact size, uses a flat and thin armature, and resists horizontal vibrations. In this respect, the armature is thin and flat while at least portions of the yoke couple to the side tines of the armature. In so doing, the yoke provides a path for the magnetic flux to flow thereby allowing use of the flat and thin armature. Consequently, the overall dimensions of the receiver assembly are reduced as compared to previous devices. Resistance to horizontal vibrations is additionally provided by the long and flat configuration of the armature.

In many of these embodiments, an armature apparatus for use in an acoustic device includes a first tine member, a second tine member, a center tine member, and a connecting portion. The first tine member has a first length, a first width, and a first thickness. The first length is greater than the first width; the first width is greater than the first thickness, and the first width and the first length define a first surface. The second tine member has a second length and a second width. The second length is greater than the second width and the second length and the second width defines a second surface. The first surface of the first tine member generally faces the second surface of the second tine member and the first surface is disposed in generally parallel relation to the second surface. The center tine member has a third length and the third length is generally parallel to the first length and the second length. The connecting portion couples the center tine member to the first surface along the first length and to the second surface along the second length. The coupling is effective to substantially eliminate vibrations along the third length of the center tine member (i.e., in the horizontal direction). The center tine member is generally disposed in a plane extending between the first tine member and the second tine member and the plane divides the first surface of the first tine member and the second surface of the second tine member to create two areas in each of the first tine member and the second tine member.

In some examples, the connecting portion is coupled to a first underside of the first tine member via a first folded section and to a second underside of the second tine member via a second folded section. The first underside is defined by the first thickness and the first length and the second underside is defined by the second thickness and the second length. In some aspects, the first folded section extends generally in the direction of the first width and the second folded section extends generally in the direction of the second width. In some others of these embodiments, the connecting portion is coupled to the first surface of the first tine member and to the second surface of the second tine member.

An electrical coil may be configured to surround the center tine member. In some of these examples, the coil does not extend beyond the first width or the second width. In other aspects, a yoke member is coupled to the armature and the first tine member and the second tine member do not extend beyond the yoke member in the direction of the first width and the second width.

In others of these embodiments, an armature apparatus for use in an acoustic device includes a first tine member, a second tine member, a center tine member, and a connecting member. The first tine member has a first length and a first width. The first length is greater than the first width and the first width and first length define a first surface. The second tine member has a second length and a second width. The second length is greater than the second width and the second length and the second width define a second surface. The first surface of the first tine member generally faces the second surface of the second tine member and the first surface is disposed in generally parallel relation to the second surface. The center tine member has a third length and the third length is generally parallel to the first length and the second length. The connecting member is coupled to the center tine member, the first tine member, and the second tine member. The center tine member is generally disposed in a plane extending between the first tine member and the second tine member and the plane divides the first surface of the first tine member and the second surface of the second tine member to create two areas in each of the first tine member and the second tine member. The plane also divides a third surface of the connecting member into two generally equal areas, a disposition of the two generally equal areas being effective to substantially eliminate vibrations along the third length of the center tine member (i.e., in the horizontal direction).

In some examples, the center tine member is coupled to the connecting member via a slot through the connecting member. In other examples, the center tine member is coupled to the connecting member via welding or some adhesive. In some other approaches, the first tine member, second tine member, and connecting member are formed integrally together.

In others of these embodiments, an acoustic assembly includes an armature, a coil, a first yoke, and at least one magnet. The armature includes a first outer tine member with a first length, a second outer tine member with a second length, and a center tine member. The center tine member is coupled to the first tine member via a connecting portion. The coil surrounds the center tine member. The at least one magnet is disposed between the first yoke member and the second yoke member. The first outer tine member is coupled to the first yoke member along the entire first length, and the second outer tine member is coupled to the first yoke member along the entire second length. The first yoke member is configured to provide a path for the flow of a flux produced in the assembly to the connecting portion to move at least portions of the armature in a vertical direction that is generally perpendicular to the first length and the second length. A second yoke member is connected to the first tine member and the second tine member. The first outer tine member is coupled to the second yoke member partially along first length, and the second outer tine member is coupled to the second yoke member partially along the second length.

In other aspects, the assembly includes a housing. The housing is separate from the first yoke member and the second yoke member. In some examples, the housing is configured to keep magnetic signals substantially confined to the assembly.

FIG. 6 illustrates a receiver assembly 100 in an embodiment of the present invention. The assembly 100 may have an armature 102, illustrated in FIGS. 7-9 which may be constructed from, for example, 50% Iron/Nickel alloy, or like material or materials. The assembly 100 may have a yoke 104 which houses magnets 106. A portion of armature 102 extends through an opening in coil structure 108. Attached to the coil structure 108 may be wire leads 110. The armature 102 may have a center tine 103 having a connection portion 112. The armature may also have tines 114. The tines 103, 114 may have a substantially rectangular shape. However, other shapes are possible as can be contemplated by those of ordinary skill in the art. A downward loop, or folded section 116 may be provided at an area where the connection portion 112 connects to the tines 114. A first section 118 extends outward from the connection portion 112. A second section 120 is folded downward, or otherwise extends substantially perpendicular from the first section 118. The tine 114 then extends from the second, folded section 120. The first section 118 and second sections 120 may be integrally formed or, in other embodiments, attached. A bottom surface 122 of the tines 114 may extend beyond a bottom surface 105 of the center tine 103.

A plane in which the center tine 103 is disposed extends to divide each of the facing surfaces (i.e., the surfaces of each tine 114 that face each other) into two areas. In one example, these areas are approximately equal. In other examples, these areas are unequal (but not minimal in size). For example, the two areas may be in a ratio of approximately 30% to approximately 70% or approximately 60% to approximately 40%. Other examples of ratios are possible. As shown, the folded sections 118 and 120 couple the center tine 103 to the tines 114 by extending downward. This placement of the center tine 103 relative to the outer tines 114 allows the size of the overall assembly to be reduced since, for example, the coil structure 108 need not extend beyond (or much beyond) the tines. The coil structure 108 also does not extend beyond the yoke 104. In one example, and as best seen in FIG. 6, the outer tines 114 are approximately 0.6 mm high, the coil structure is approximately 0.6 mm high, and the yoke is approximately 1.0 mm high. The overall assembly 100 is approximately 5.0 mm long.

Figure 8:
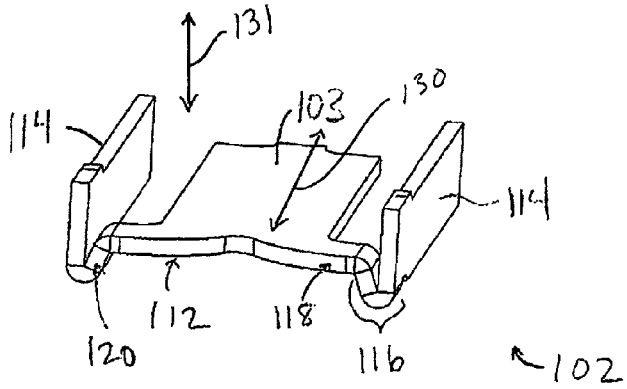
FIG. 8 is a perspective view of the armature used in the receiver assembly of FIG. 6, in an embodiment of the present invention.
Figure 9:
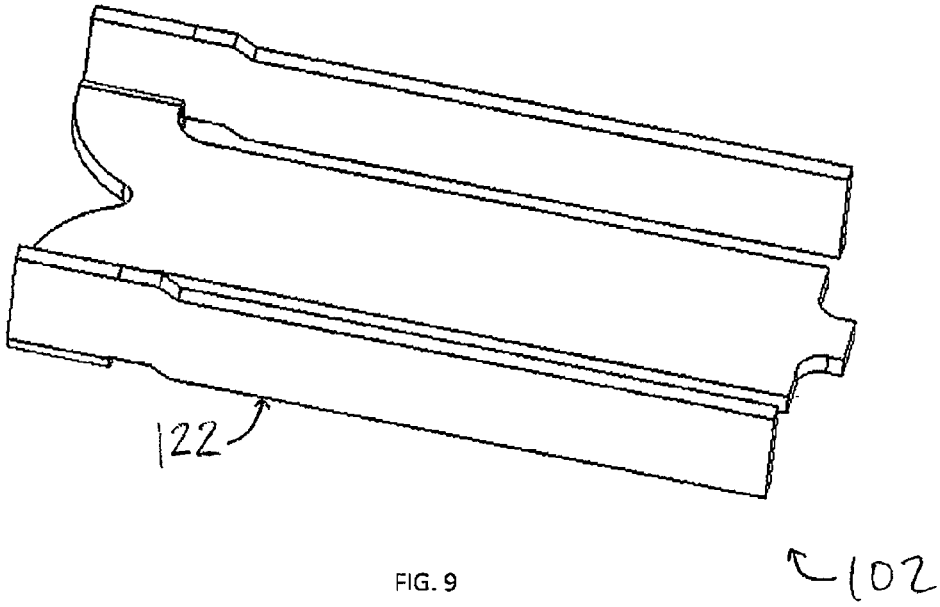
FIG. 9 is another perspective view of the armature of FIG. 7.

Additionally, coupling of the folded sections 118 and 120 to the underside of the tines 114 along the lengths of the tines (the lengths being in the direction indicated by the axis labeled 130 in FIG. 8) provides strength and support such that the horizontal movement is prevented from occurring or substantially prevented from occurring in the center tine 103 (e.g., horizontal movement is shown as being along (in the direction of) the axis labeled 130 in FIG. 8). Consequently, even movement of the center tine 103 in the vertical direction (shown in the direction indicated by the axis labeled 131) does not result in any (or in substantially any) horizontal movement (along the axis 130).

In operation, the coil structure 108 induces a flux in the armature 102. The flux flows to the magnets 106 which move the tip of the center tine 103 up and down (in the direction indicated by the arrow labeled 131). The center tine 103 is connected through a connecting strap or wire 107 to the movable portion 111 of the diaphragm assembly 109, such that motion of the center tine causes proportional motion of the diaphragm assembly. This in turn pushes air in and out of an opening 115 in the receiver housing, thus generating sound outside of the housing. The housing includes a lower section 101 and an upper section 113.

Figure 10:
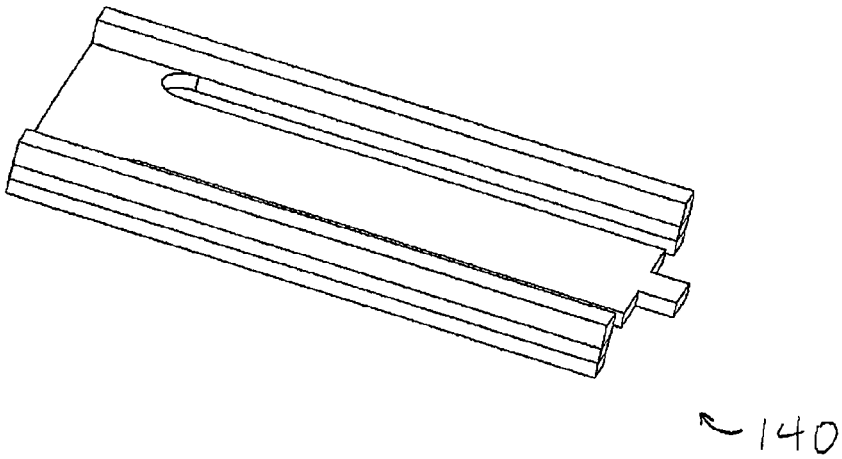
FIG. 10 is a perspective view of an armature having laminated parts in an embodiment of the present invention.
Figure 11:
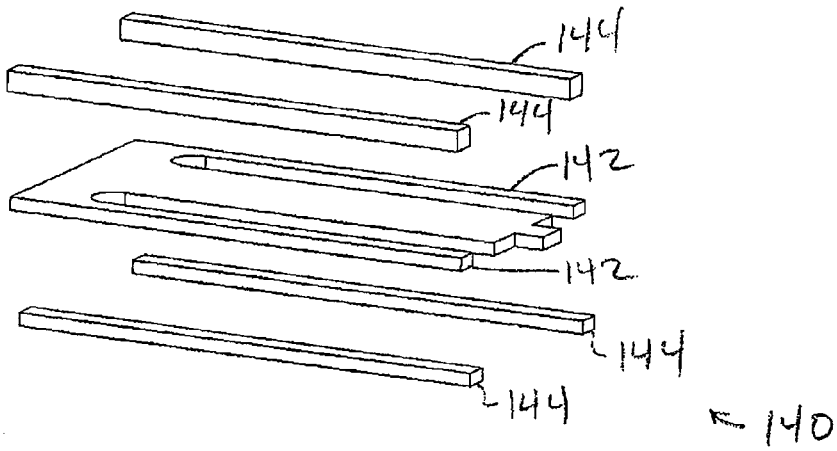
FIG. 11 is an exploded view of the armature of FIG. 10.
Figure 12:
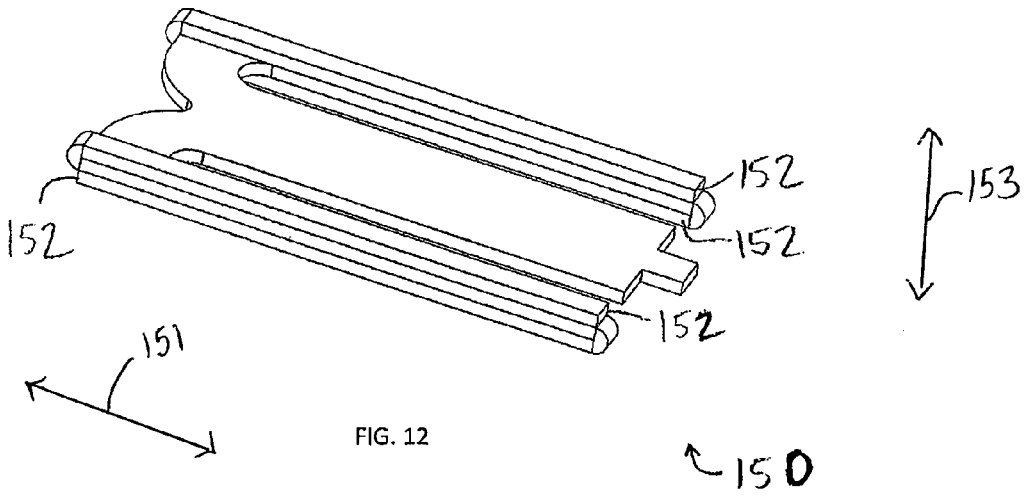
FIG. 12 is a perspective view of an armature having foldable sections in an embodiment of the present invention.
Figure 13:
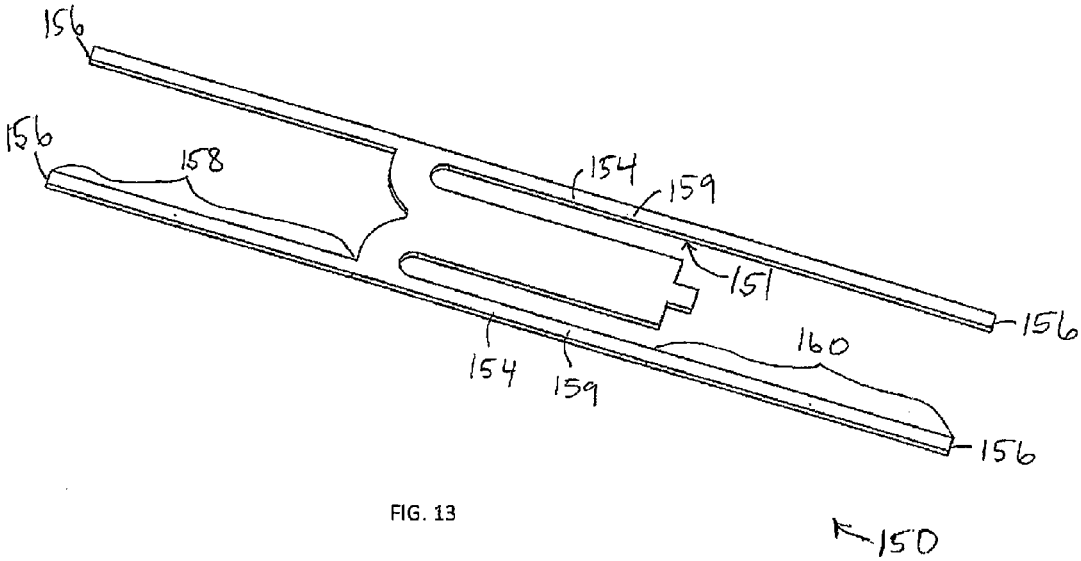
FIG. 13 is a perspective view of the armature of FIG. 12 in an unfolded state.

FIG. 10 illustrates an armature 140 having tines 142 which have added material layers 144 or sections. An objective when constructing an armature is to construct the side tines wherein the area meets or exceeds the cross-sectional area of the center tine. As a result, in this embodiment, the tine cross-sectional area is sufficient to carry the magnetic flux while the armature width is minimized. The vertical symmetry of the armature may prevent axial vibration. The added layers 144 may be provided via, for example, a lamination process. Other processes are contemplated as known to those skilled in the art. FIG. 11 provides an exploded view of the added layers 144 and tines 142. FIG. 12 shows an armature 150 in which added layers 152 are provided to tines 154 by folding legs 156. FIG. 13 shows the armature 150 in an unfolded state. In an embodiment, a section 158 of the legs 156 may be folded to contact a top surface 159 of the tine 154. A second section 160 may be folded to contact a bottom surface 151 of the tine 154. In another embodiment, the sections of the legs may be folded in an opposite direction. It should be noted that the layers which are added to the tines 142 may be asymmetrical (i.e., a thickness of the added materials on a top portion may not be equal to a thickness of the layers added to a bottom portion). In other embodiments, the added layers may be of equal thicknesses at a top portion and a bottom portion. As a general comment on FIGS. 8-13, these embodiments may rely on intimate contact between the "laminated" parts for proper magnetic function. In practice, this can be accomplished by welding (resistance weld, laser weld, diffusion weld, etc.).

In the above-mentioned examples, coupling the center tines to the side tines along a length of the side tines provides strength and support such that horizontal movement (i.e., vibrations) is prevented from occurring or substantially prevented from occurring in the center tines (e.g., horizontal movement is shown as being along the axis labeled 151 in FIG. 12). Consequently, even movement of the center tines in the vertical direction (shown in the direction indicated by the axis labeled 153) does not result in any (or in substantially any) horizontal movement (along the axis 151).

Figure 14:
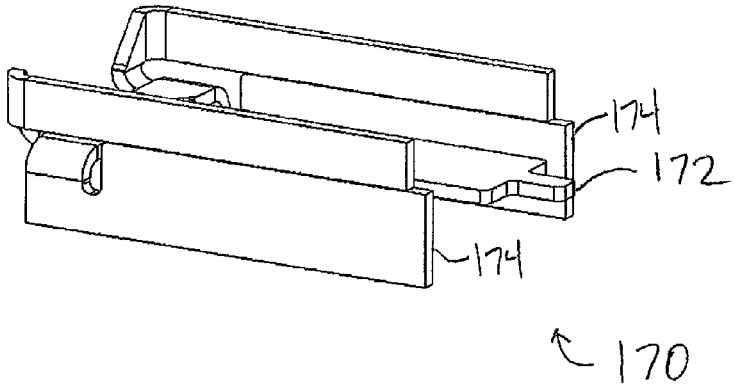
FIG. 14 is a perspective view of an armature in an embodiment of the present invention.
Figure 15:
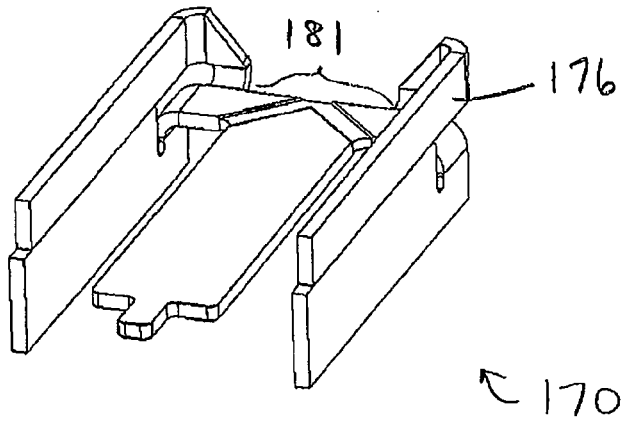
FIG. 15 is another perspective view of the armature of FIG. 14.
Figure 16:
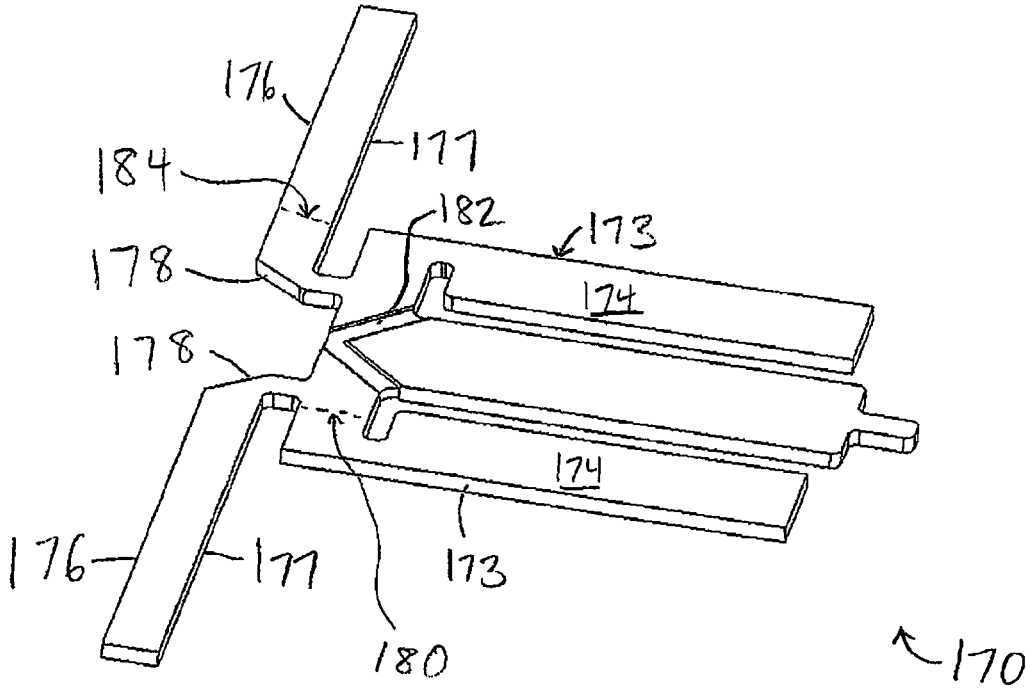
FIG. 16 is a perspective view of the armature of FIG. 14 in an unfolded or otherwise unassembled state.

FIGS. 14-16 illustrate an armature 170 having a center tine 172 and side tines 174. The armature 170 also has leg portions 176 attached to the tines 174 at a pivot section 178. In an embodiment, tines 174 are folded downward and the leg portions 176 are folded upwards such that a bottom surface 177 of the leg portions 176 is adjacent to a top surface 173 of the tines 174. More specifically, the tines 174 are folded at line 180. The leg portions 176 are folded at line 184. A connection portion 181 is provided having bridge sections 182. The bridge sections 182 serve to allow adjustment of the mechanical stiffness of the center tine 172. The vertical symmetry of the armature 170 may prevent axial vibration.

Figure 17:
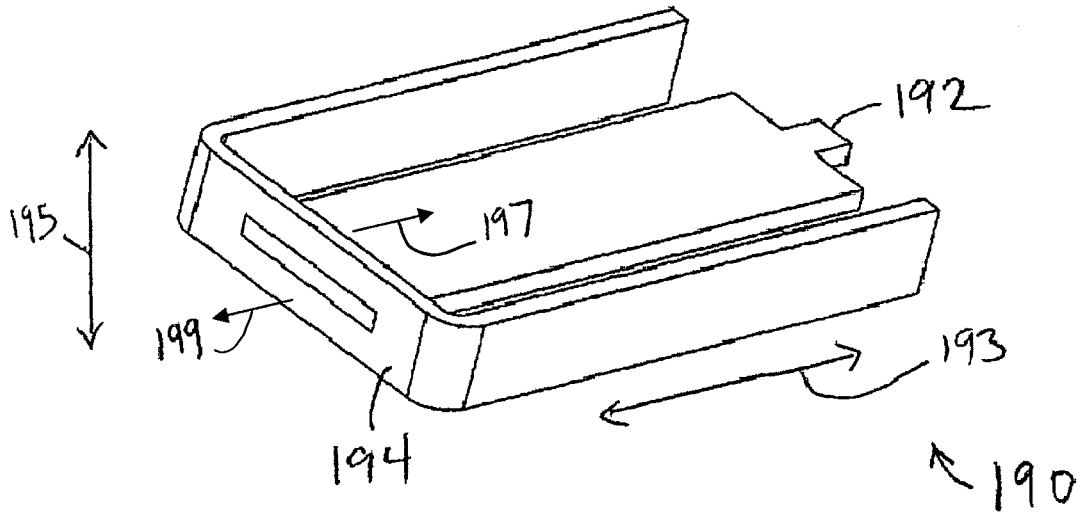
FIG. 17 is a perspective view of an armature in an embodiment of the present invention.
Figure 18:
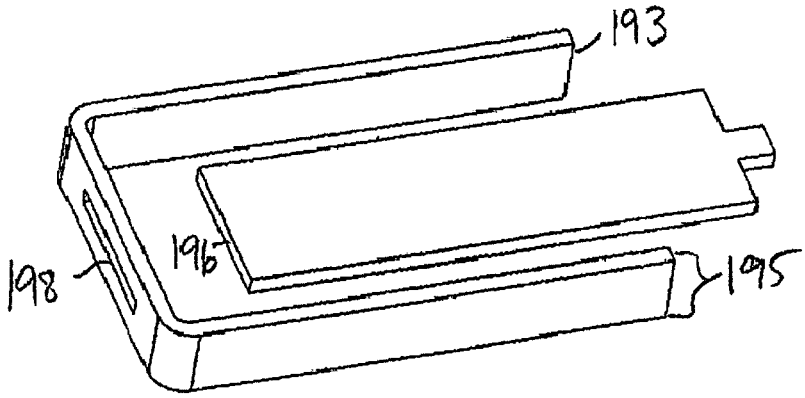
FIG. 18 is an exploded view of the armature of FIG. 17.

FIGS. 17 and 18 illustrate an armature 190 having a center tine 192 that is attached, possibly through welding, or other attachment method, to a connection portion 194. The center tine 192 has an end 196 which is attached to the connection portion 194 at a slot 198 in the connection portion 194. The welded area provides symmetry that prevents axial (horizontal) vibration as described in detail below. Horizontal motion is prevented at the welded area. Tines 193 extend from the connection portion 194 in a substantially perpendicular manner. The tines 193 have a height 195 which extends above and below the center tine 192.

The substantial reduction or elimination of horizontal movement of the center tine 192 (indicated by the arrow labeled 193) is obtained at least in part by the coupling of the center tine 192 to the connection portion 194 such that approximately one-half of the area of the connection portion 194 is above the center tine 192 (at the connection point or connection area) and approximately one half of the area of the connection portion 194 is below the center tine 192 (at the connection point or connection area). The stiffness of the two sections of the connection portion 194 (e.g., as measured in newtons/meter) is substantially equal thereby substantially reducing or eliminating horizontal vibrations of the center tine 192 when the center tine 192 move is a vertical (i.e., up/down) direction (indicated by the arrow labeled 195).

More specifically, upward movement of the center tine 192 in the direction of the arrow 195 causes the upper portion of the connection portion 197 to move in the direction indicated by the arrow labeled 197 and the bottom part of the connection portion 194 to move in the direction indicated by the arrow labeled 199. However, the stiffness of the two equal portions of the connection portion 194 is configured to be equal or approximately equal and hence any force that could be produced to move the center tine 192 in the direction of arrow 193 is prevented from being formed.

As with some of the other examples described herein, the positioning of the center tine 192 with respect to the outer tines, allows the overall structure in which the armature fits to be reduced. For example, any coil that is wound around the center tine does not extend above a yoke. In addition, the outer tines do not extend beyond the yoke.

In one example, the center tine 192 is approximately 4.0 mm long, approximately 1.5 mm wide, and approximately 0.15 thick. The connection portion 194 is approximately 2.5 mm long, approximately 0.6 mm high, and approximately 0.15 mm thick. The outer tines 193 are approximately 5.0 mm long, approximately 0.6 mm wide, and approximately 0.15 mm thick. Other examples of dimensions may also be used.

Figure 19:
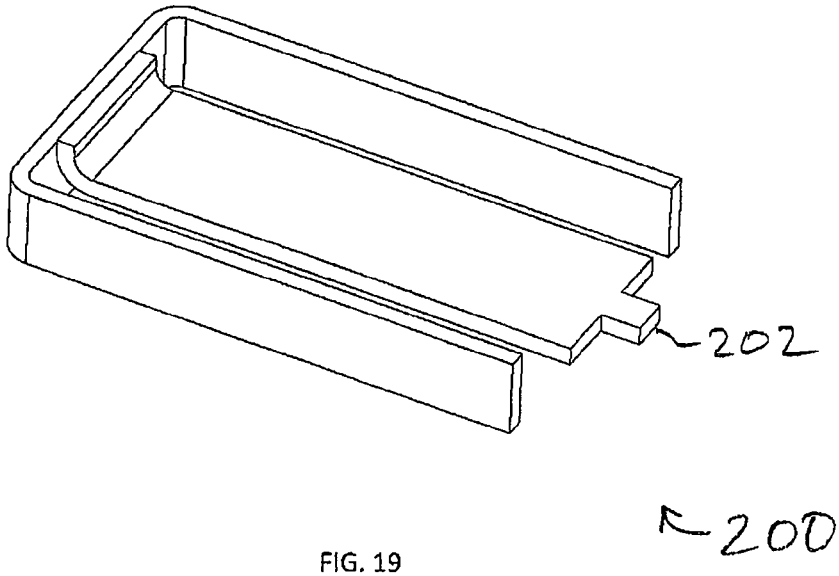
FIG. 19 is a perspective view of an armature in an embodiment of the present invention.
Figure 20:
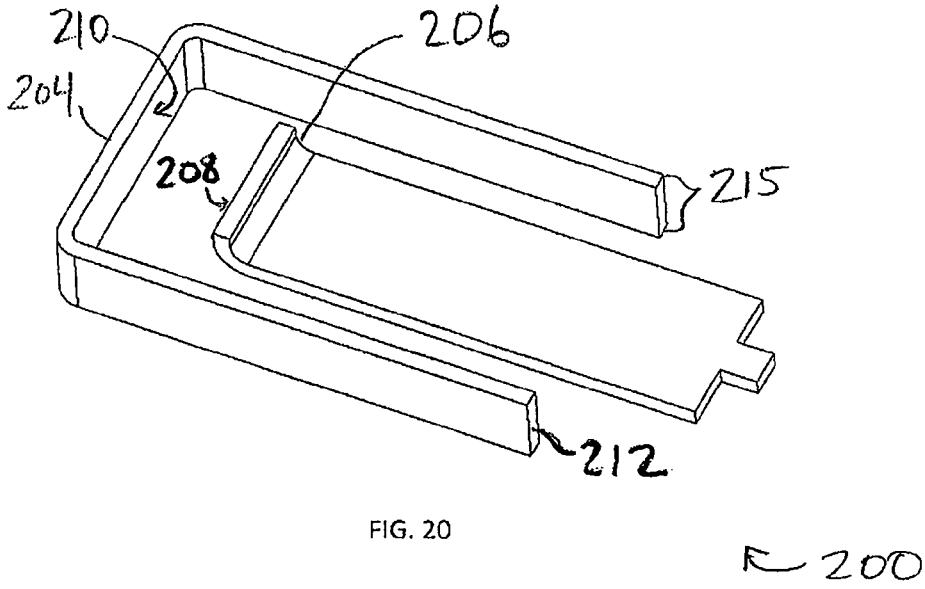
FIG. 20 is an exploded view of the armature of FIG. 19.

Similarly, FIGS. 19 and 20 illustrate an armature 200 having a center tine 202 which is attached to a connection portion 204. The center tine 202 may have a folded portion 206 having a surface 208 which contacts a surface 210 of the connection portion 204. The location of the welded area can be chosen so as to provide symmetry that prevents axial vibration. Tines 212 extend from the connection portion 204 in a substantially perpendicular manner. The tines 212 have a height 215 which extends above and below the center tine 202. Horizontal motion is prevented at the welded area. As with the examples mentioned elsewhere herein, the positioning and securing of the side tines with respect to the center tine 202 prevents or substantially prevents horizontal vibration as well as provides for a compact assembly.

Figure 21:
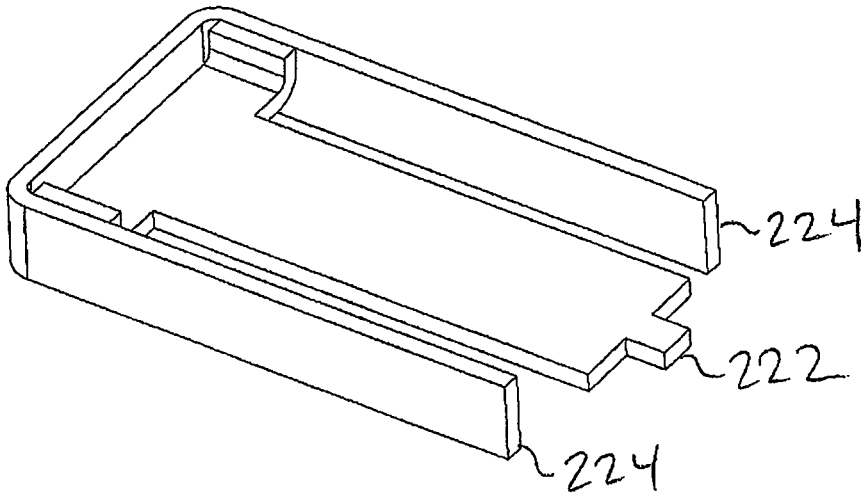
FIG. 21 is a perspective view of an armature in an embodiment of the present invention.
Figure 22:
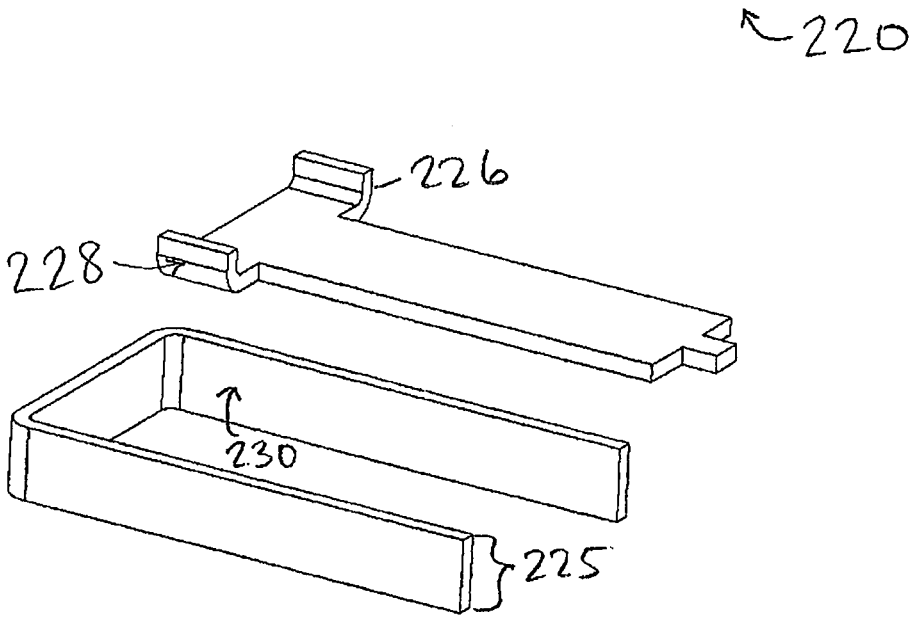
FIG. 22 is an exploded view of the armature of FIG. 21.

FIGS. 21 and 22 illustrate another armature 220 having a center tine 222 which is welded to side tines 224. Specifically, the center tine 222 has curved side portions 226 which extend from sides of the center tine 222 and have a surface 228 which contacts, and is welded to, surfaces 230 of the side tines 224. Horizontal motion is prevented at the welded areas. The tines 224 have a height 225 which extends above and below the center tine 222. As with the examples mentioned elsewhere herein, the positioning and securing of the side tines 224 with respect to the center tine 222 prevents or substantially prevents horizontal vibration as well as provides for a compact assembly.

Figure 23:
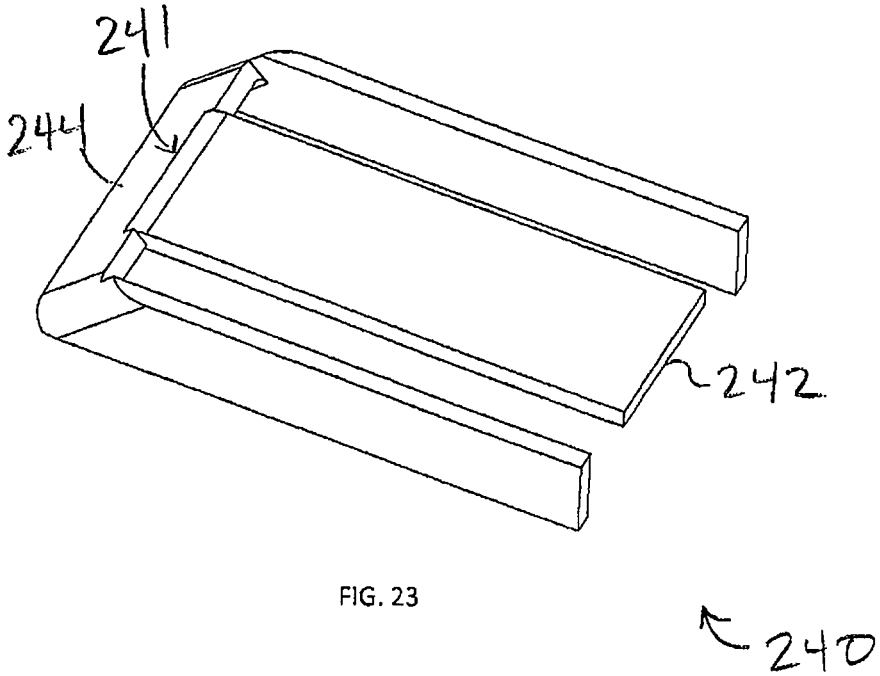
FIG. 23 is a perspective view of an armature in an embodiment of the present invention.

FIG. 23 illustrates an armature 240 having a center tine 242 which is attached to, or otherwise integrally formed with, a connection portion 244. As opposed to the armatures described above, the connection portion 244 is not positioned at a right angle or substantially perpendicular to the center tine 242, but at more of a slant. Moreover, the center tine 242 may be attached at a top section 241 of the connection portion 244. Utilizing a diagonal connection may reduce axial motion.

Figure 24:
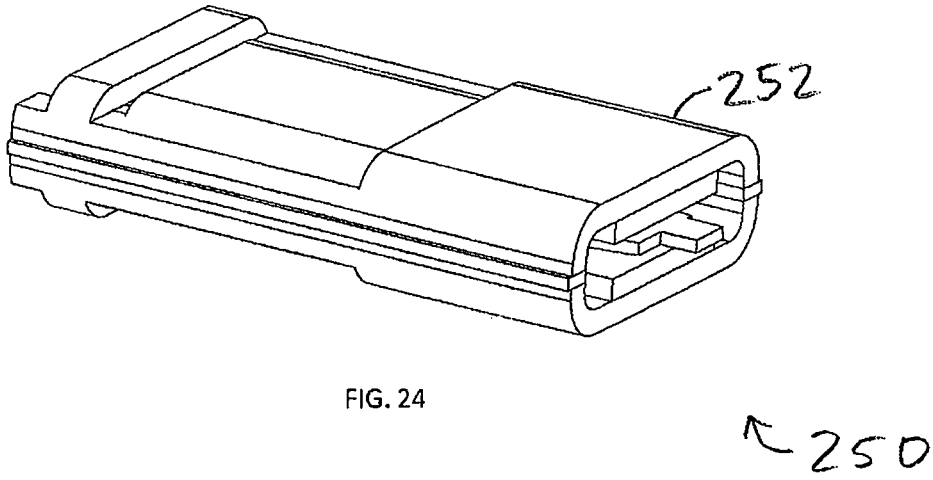
FIG. 24 is a perspective view of a receiver assembly in an embodiment of the present invention.
Figure 25:
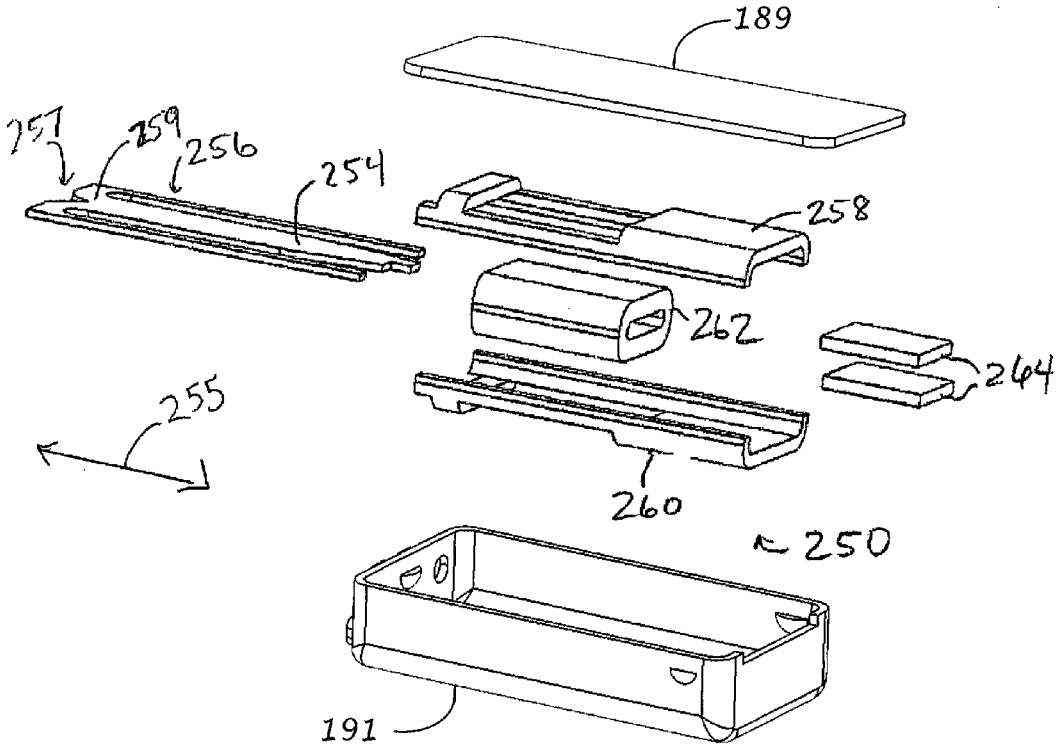
FIG. 25 is an exploded view of the receiver assembly of FIG. 24.

FIGS. 24 and 25 illustrate a receiver assembly 250 in which a yoke 252 may have an extended length to support a center tine 254 of an armature 256. The yoke 252 may be comprised of an upper yoke section 258 and a lower yoke section 260. A portion of the armature 256 may be contained within a coil structure 262. Magnets 264 may also be provided within the yoke 252. Because of the extended length of the yoke 252, magnetic flux is carried to an area 257 near a connection portion 259 of the armature 256. In operation, the coil structure 262 induces a flux in the armature 256. The flux flows to the magnets 264 which move the tip of the center tine 254 up and down. A top housing 189 couples to a bottom housing 191 to house the receiver assembly. The top housing 189 and the bottom housing 191 are constructed of a material of sufficient magnetic permeability to contain the magnetic signals produced in the assembly 250. For example, the housings may be constructed from the Carpenter HyMu "80"® alloy. Other examples of construction materials may also be used.

Figure 26:
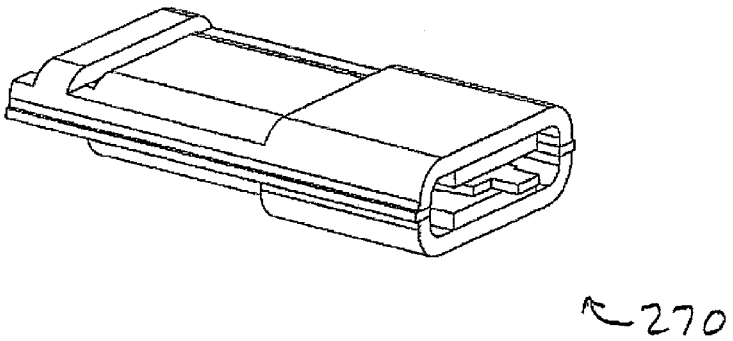
FIG. 26 is a perspective view of a receiver assembly in an embodiment of the present invention.
Figure 27:
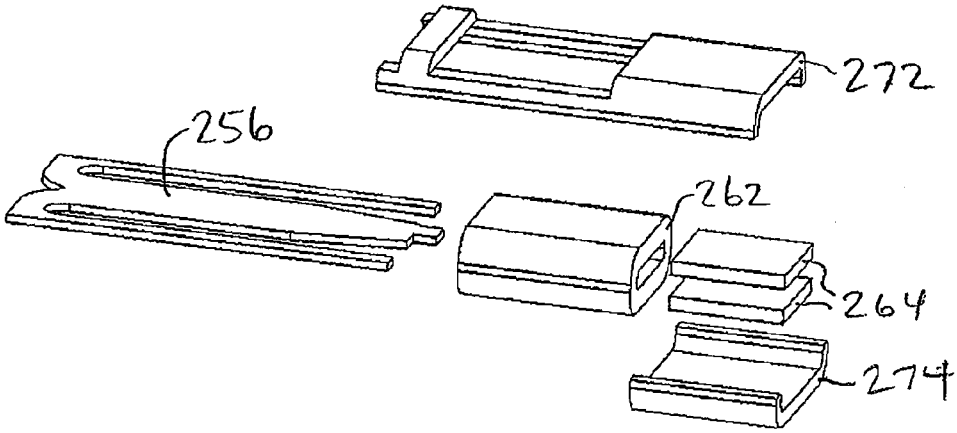
FIG. 27 is an exploded view of the receiver assembly of FIG. 26.

FIGS. 26 and 27 illustrate a receiver assembly 270 having similar components as the receiver assembly 250. However, in this embodiment, only an upper yoke 272 is extended; a lower yoke 274 has a shorter length.

The receiver assembly 250 is configured to be of a small and compact size, uses a flat and thin armature 256, and resists horizontal vibrations (in the direction indicated by the arrow labeled 255). In this respect, the armature 256 is thin and flat (e.g., approximately 0.15 mm thick, approximately 5.0 mm long, and approximately 1.9 mm wide) while at least portions of the yoke 252 couple to the side tines of the armature 256. In so doing, the yoke 252 provides a path for the magnetic flux to flow along the armature 256 thereby allowing use of a flat and thin armature. Consequently, the overall dimensions of the receiver assembly 250 are reduced as compared to previous devices. Resistance to horizontal vibrations in the direction of the arrow labeled 255 is provided by the long and flat configuration of the armature.

In one example, the overall length of the assembly 250 is approximately 5.0 mm. The height of the yoke is approximately 1.0 mm. The height of the coil is approximately 0.6 mm. Other examples of dimensions are possible.

Figure 28:
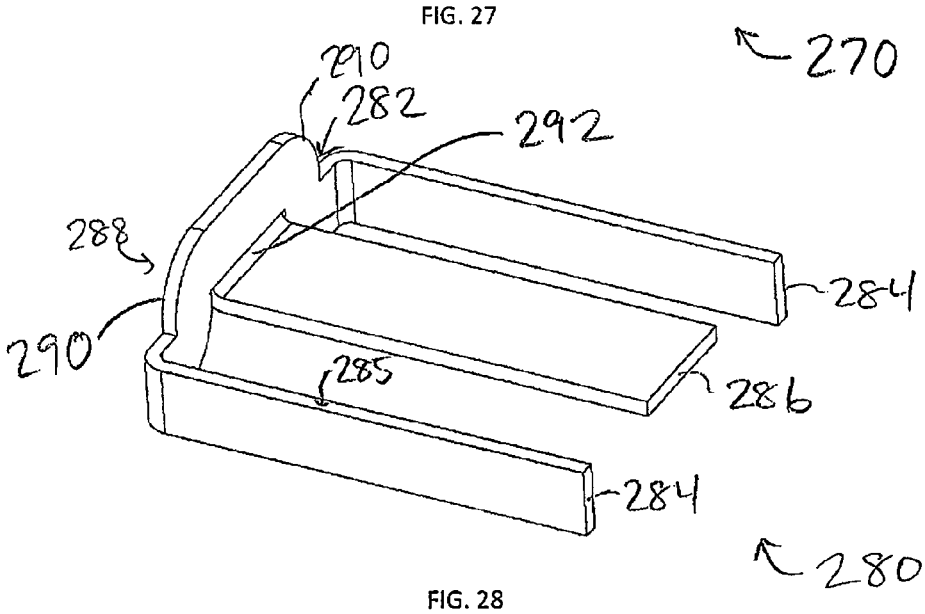
FIG. 28 is a perspective view of an armature in an embodiment of the present invention.

FIG. 28 illustrates an armature 280 having a connection portion 282 attached to, or otherwise integrally formed with, side tines 284. A center tine 286 is attached to, or otherwise extends from, the connection portion 282. The connection portion 282 may have a raised section 288 which is curved at sides 290. The raised section 288 may extend to a height beyond a surface 285 of the side tines 284. The shape of the connection portion 282 may provide a balancing effect to pivot motions at an area 292 where the center tine 286 extends from the connection portion 282. As a result, there may be a zero net horizontal motion along a long axis of the armature 280.

Figure 29:
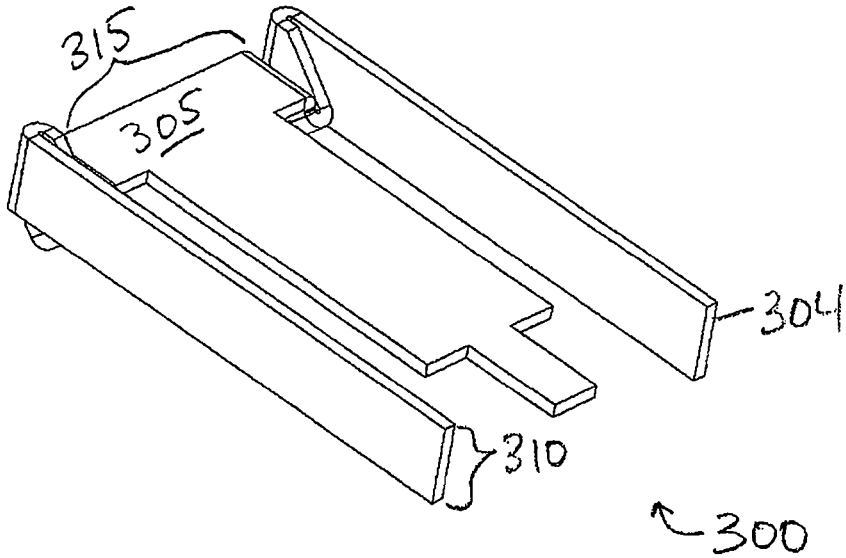
FIG. 29 is a perspective view of an armature in a folded state in an embodiment of the present invention.
Figure 30:
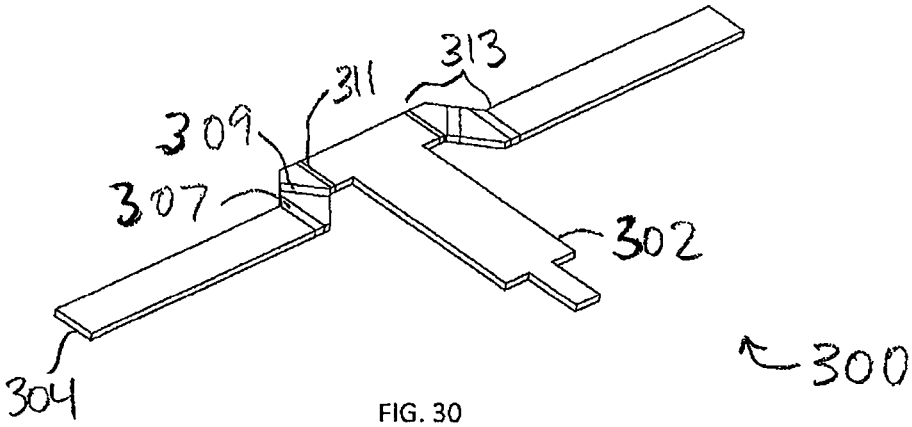
FIG. 30 is a perspective view of the armature of FIG. 29 in an unfolded state.

FIGS. 29 and 30 illustrate an armature 300 having a center tine 302 connected to side tines 304 by a series of diagonal folds along a connection portion 305. FIG. 30 shows the armature 300 in an unfolded state. The side tines 304 may be folded at lines 307, 309, 311 to position the side tines 304 adjacent to the center tine 302 in an orientation perpendicular to the center tine 302. The side tines 304 may have a height 310 which extends above and below the center tine 302. To facilitate diagonal folding, the connection portion 305 may be shaped with a slanted section 313 which extends from either side in a manner non-linear to a central section 315 of the connection portion 305.

Preferred embodiments of this invention are described herein, including the best mode known to the inventors for carrying out the invention. It should be understood that the illustrated embodiments are exemplary only, and should not be taken as limiting the scope of the invention.

What is claimed:

1. An armature apparatus for use in an acoustic device, the apparatus comprising:

a first tine member having a first length, a first width, and a first thickness, the first length being greater than the first width, the first width being greater than the first thickness, the first width and first length defining a first surface;

a second tine member having a second length, a second width, and a second thickness, the second length being greater than the second width, the second width being greater than the second thickness, the second length and the second width defining a second surface;

such that the first surface of the first tine member generally faces the second surface of the second tine member and such the first surface is disposed in generally parallel relation to the second surface;

a center tine member having a third length, the third length being generally parallel to the first length and the second length;

a connecting portion coupling the center tine member to the first surface along the first length and to the second surface along the second length, the coupling being effective to substantially eliminate vibrations along the third length of the center tine member;

such that the center tine member is generally disposed in a plane extending between the first tine member and the second tine member and such that the plane divides the first surface of the first tine member and the second surface of the second tine member to create two areas in each of the first tine member and the second tine member;

wherein the connecting portion is coupled to a first underside of the first tine member via a first folded section and to a second underside of the second tine member via a second folded section, the first underside being defined by the first thickness and the first length and the second underside being defined by the second thickness and the second length;

wherein the first folded section extends generally in the direction of the first width and the second folded section extends generally in the direction of the second width.

2. The apparatus of claim 1 wherein the connecting portion is coupled to the first surface of the first tine member and to the second surface of the second tine member.

3. The apparatus of claim 1 further comprising an electrical coil that surrounds the center tine member.

4. The apparatus of claim 1 further comprising a yoke member that is coupled to the armature wherein the first tine member and the second tine member do not extend beyond the yoke member in the direction of the first width and the second width.

* * * * *